US010195728B2

(12) United States Patent
Tanji

(10) Patent No.: US 10,195,728 B2
(45) Date of Patent: Feb. 5, 2019

(54) FASTENER DRIVING TOOL

(71) Applicant: HITACHI KOKI CO., LTD., Tokyo (JP)

(72) Inventor: Isamu Tanji, Hitachinaka (JP)

(73) Assignee: Koki Holdings Co., Ltd., Tokyo (JP)

( * ) Notice: Subject to any disclaimer, the term of this patent is extended or adjusted under 35 U.S.C. 154(b) by 414 days.

(21) Appl. No.: 14/908,968

(22) PCT Filed: Jun. 27, 2014

(86) PCT No.: PCT/JP2014/067144
§ 371 (c)(1),
(2) Date: Jan. 29, 2016

(87) PCT Pub. No.: WO2015/015967
PCT Pub. Date: Feb. 5, 2015

(65) Prior Publication Data

US 2016/0176032 A1 Jun. 23, 2016

(30) Foreign Application Priority Data

Jul. 31, 2013 (JP) ..... 2013-159765

(51) Int. Cl.
*B25C 1/06* (2006.01)

(52) U.S. Cl.
CPC ..... *B25C 1/06* (2013.01)

(58) Field of Classification Search
CPC ..... B25F 7/02; B25C 1/06
USPC ..... 227/8, 120, 130, 107, 132, 134; 173/217
See application file for complete search history.

(56) References Cited

U.S. PATENT DOCUMENTS 4,515,303 A 5/1985 Schadlich et al.
5,437,339 A 8/1995 Tanaka
7,815,088 B2 10/2010 Fielitz et al.
7,832,610 B2 * 11/2010 Tanimoto ..... B25C 1/06 227/131

(Continued)

FOREIGN PATENT DOCUMENTS

DE 102005000089 A1 1/2007
EP 1980369 A2 10/2008

(Continued)

OTHER PUBLICATIONS

Extended European Search Report dated Feb. 15, 2017 issued in European Patent Application No. 14832851.1.
International Search Report PCT/JP2014/067144 dated Aug. 12, 2014 with English translation.

*Primary Examiner* — Nathaniel Chukwurah
(74) *Attorney, Agent, or Firm* — McDermott Will & Emery LLP

(57) ABSTRACT

A nail driving machine capable of reducing vibrations is provided. A nail driving machine that strikes a nail to be driven into a workpiece W includes a driver blade that is provided to be capable of moving along an axis and moves in a first direction to strike the nail, a weight that when the driver blade strikes the nail, moves in a second direction reverse to the first direction, and a coil spring that is compressed along the axis to generate a repulsive force before the driver blade strikes the nail and causes the driver blade to move in the first direction to strike the nail due to the repulsive force and causes the weight to move in the second direction due to the repulsive force.

11 Claims, 10 Drawing Sheets

(56) References Cited

U.S. PATENT DOCUMENTS

| | | | | |
|---|---|---|---|---|
| 8,186,553 | B2 * | 5/2012 | Tanimoto | B25C 1/06 173/81 |
| 8,393,512 | B2 | 3/2013 | Tanimoto et al. | |
| 2008/0257934 | A1 * | 10/2008 | Tanimoto | B25C 1/06 227/146 |
| 2009/0078734 | A1 * | 3/2009 | Chang | B25C 1/06 227/107 |
| 2009/0236387 | A1 * | 9/2009 | Simonelli | B25C 1/008 227/8 |
| 2010/0133313 | A1 * | 6/2010 | Nakano | B25C 1/008 227/8 |
| 2012/0211540 | A1 * | 8/2012 | Kondou | B25C 1/06 227/140 |

FOREIGN PATENT DOCUMENTS

| | | | |
|---|---|---|---|
| EP | 2140979 | A1 | 1/2010 |
| EP | 2489474 | A2 | 8/2012 |
| EP | 2607022 | A2 | 6/2013 |
| JP | 59-59361 | A | 4/1984 |
| JP | 5-261677 | A | 10/1993 |
| JP | 6-33675 | A | 5/1994 |
| JP | 2008-238288 | A | 10/2008 |
| JP | 2008-260124 | A | 10/2008 |
| JP | 2009-000756 | A | 1/2009 |
| JP | 2010-125578 | A | 6/2010 |
| JP | 2012-236251 | A | 12/2012 |

* cited by examiner

FASTENER DRIVING TOOL

CROSS-REFERENCE TO RELATED APPLICATIONS

This application is the U.S. National Phase of PCT/JP2014/067144 filed Jun. 27, 2014, which claims priority to Japanese Patent Application No. 2013-159765 filed Jul. 31, 2013. The subject matter of each is incorporated herein by reference in entirety.

TECHNICAL FIELD

The present invention relates to a fastener driving tool that drives a fastener such as nail, pin, and tucker into a workpiece such as wood and gypsum board.

BACKGROUND ART

An example of a fastener driving tool that drives a fastener into a workpiece by making use of the repulsive force of an elastic mechanism is described in Patent Document 1. The fastener driving tool described in Patent Document 1 includes an electric motor disposed inside a housing, an output shaft of the electric motor, a drum, a wire wound around the drum, an operating member to which the wire is connected, a blade attached to the operating member, a clutch mechanism that connects and disconnects the output shaft to and from the drum, a cylindrical spring guide disposed inside the housing, and a coil spring serving as an elastic mechanism disposed inside the spring guide and interposed between a partition wall of the housing and the operating member.

The clutch mechanism connects or disconnects a power transmission path for transmitting the torque of the electric motor to the drum. When the clutch mechanism connects the power transmission path and the torque of the electric motor is transmitted to the drum, the drum rotates in a forward direction to reel up the wire, causing the operating member to move toward the interior of the spring guide. When the operating member moves toward the interior of the spring guide, the coil spring is compressed, thereby accumulating elastic force.

Then, when the clutch mechanism disconnects the power transmission path, the drum rotates in a reverse direction due to the repulsive force of the coil spring, so that the wire is reeled out from the drum. As a result, the operating member moves toward the exterior of the spring guide, so that the fastener is struck by the blade to be driven into the workpiece.

RELATED ART DOCUMENT

Patent Document

Patent Document 1: Japanese Patent Application Laid-Open Publication No. 2008-238288

SUMMARY OF THE INVENTION

Problems to be Solved by the Invention

However, the fastener driving tool described in Patent Document 1 has a possibility that the fastener driving tool may vibrate due to the reaction generated upon striking the fastener, which is a problem to be improved.

The object of the present invention is to provide a fastener driving tool in which vibrations can be reduced.

Means for Solving the Problems

A fastener driving tool according to an embodiment, includes an operating member that is provided to be capable of moving along a given direction, the operating member moving in a first direction of the given direction and striking the fastener, a weight that moves in a second direction reverse to the first direction when the operating member moves in the first direction, and an elastic mechanism that is compressed along the given direction to generate a repulsive force before the operating member moves in the first direction, in which the operating member moves in the first direction by the repulsive force of the elastic mechanism and strikes the fastener, the weight moves in the second direction by the repulsive force, the operating member is located at one end of the elastic mechanism in the given direction, the weight is located at other end of the elastic mechanism in the given direction, and the repulsive force generated when the elastic mechanism is compressed is received by the operating member located at the one end and the weight located at the other end.

Effects of the Invention

According to the present invention, when the operating member moves in a first direction, a weight moves in a second direction to reduce vibrations.

BRIEF DESCRIPTIONS OF THE DRAWINGS

Figure 1:
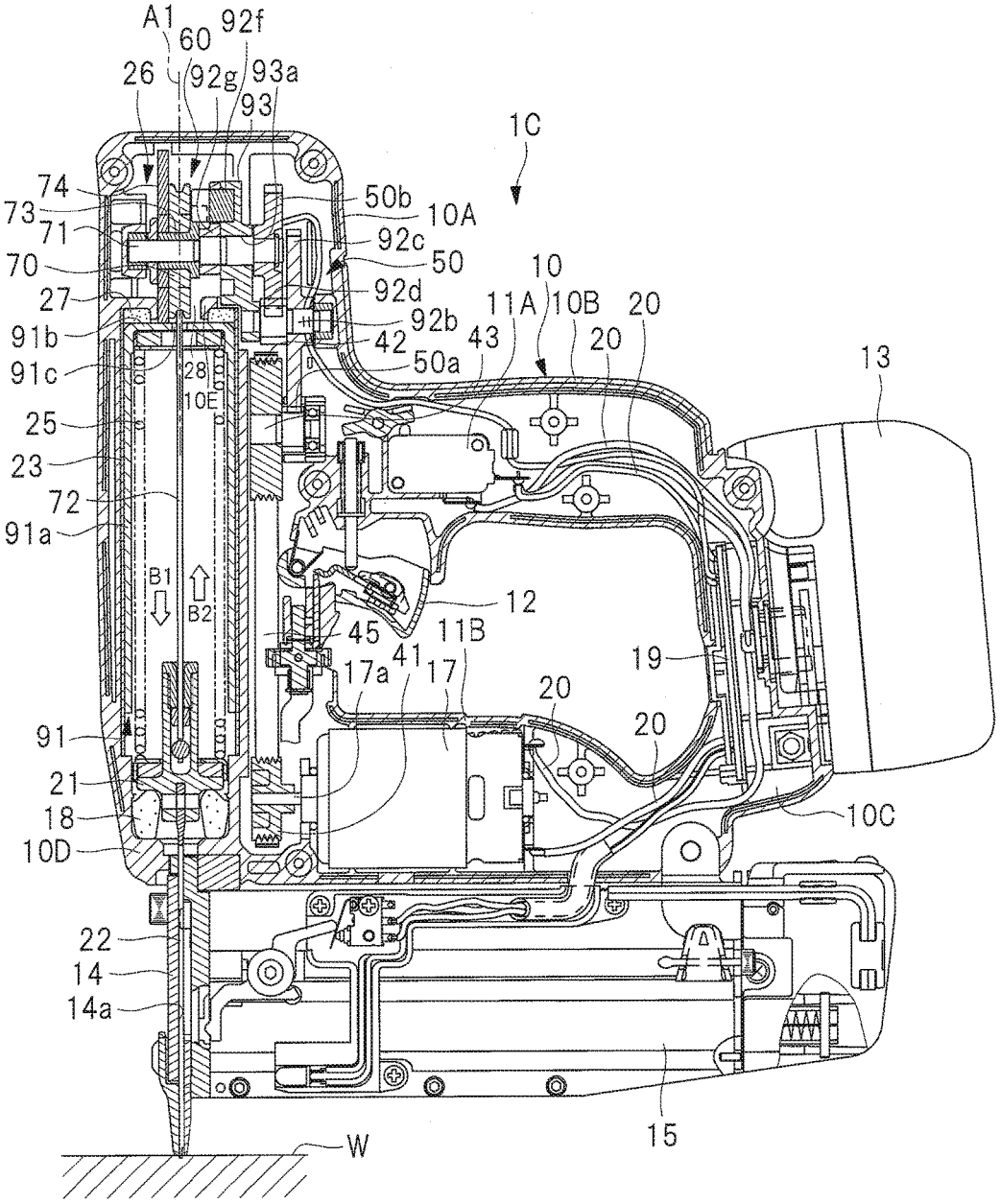
FIG. 1 is a cross-sectional view showing a nail driving machine according to a first embodiment of the present invention.
Figure 2:
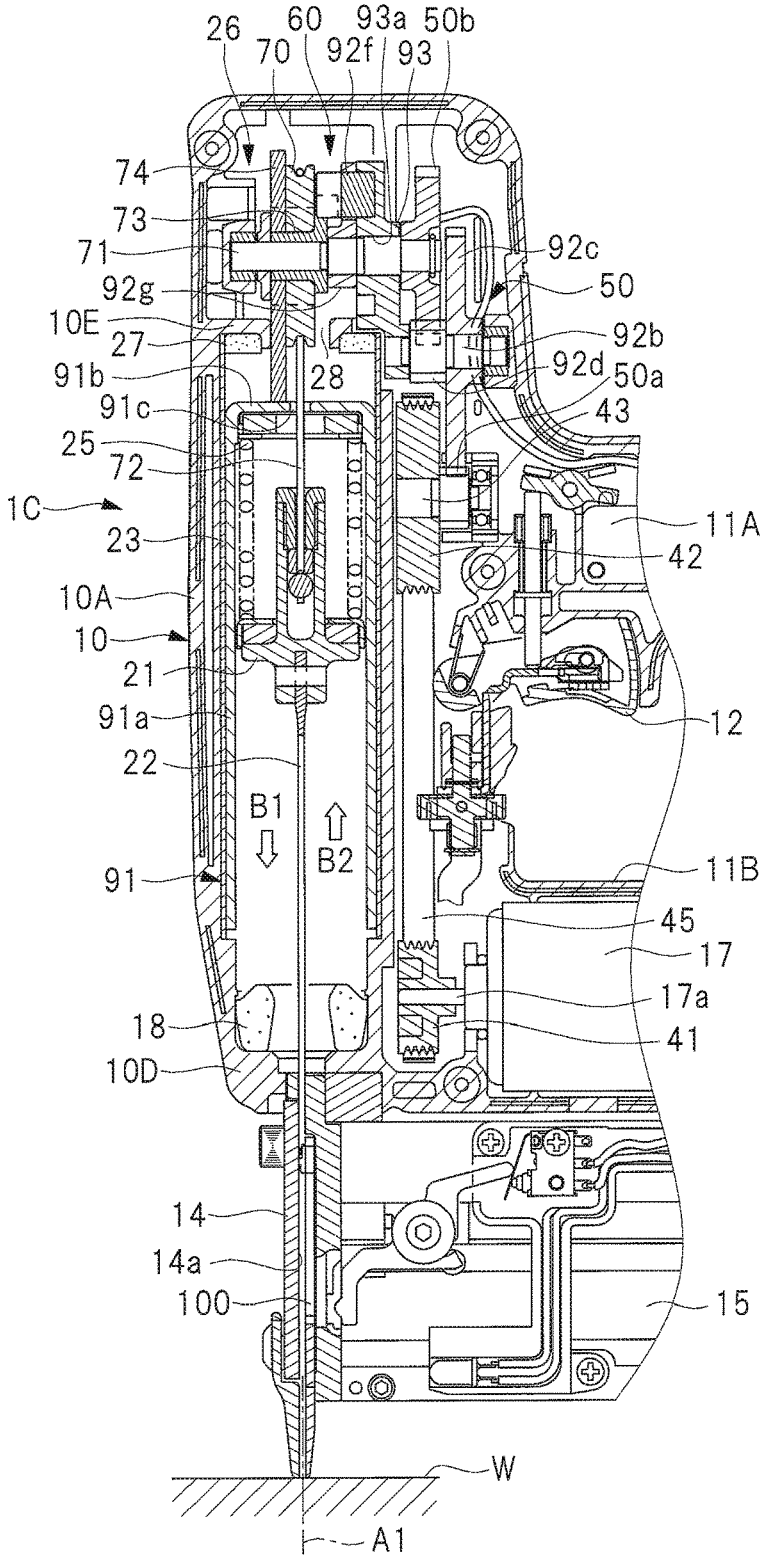
FIG. 2 is a cross-sectional view of a part of the nail driving machine of FIG. 1.
Figure 4:
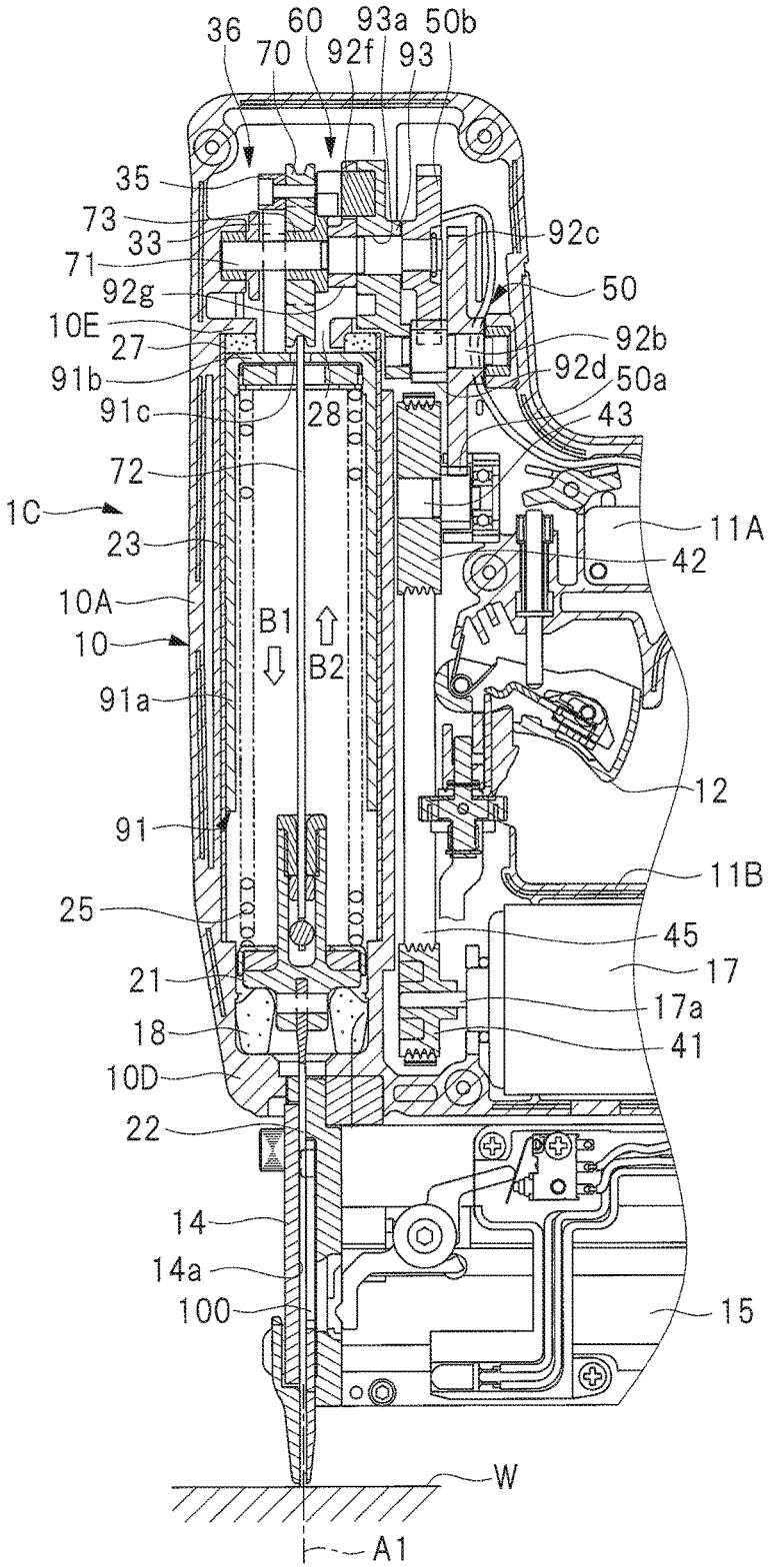
Figure 5:
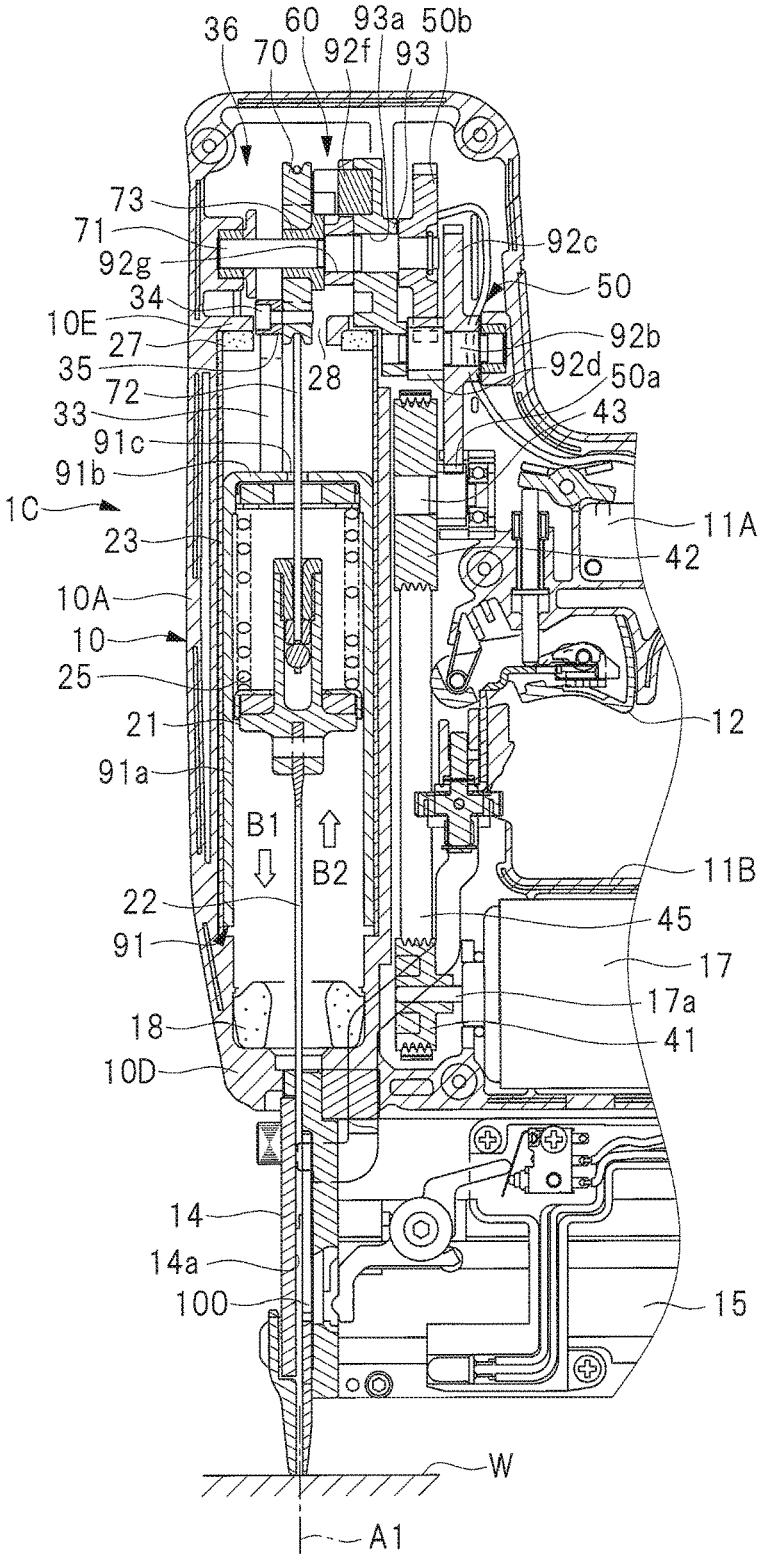
Figure 7:
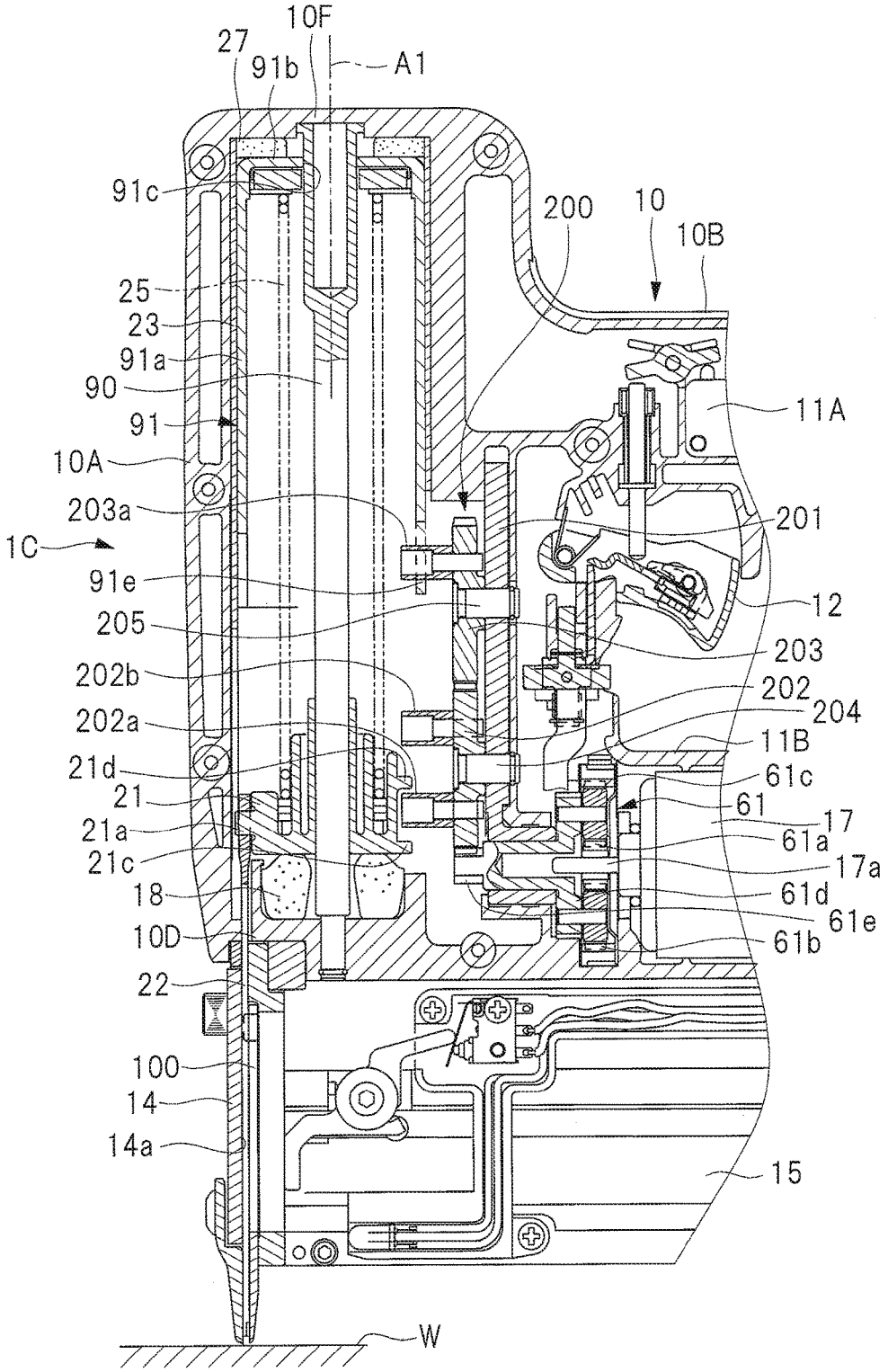
Figure 8:
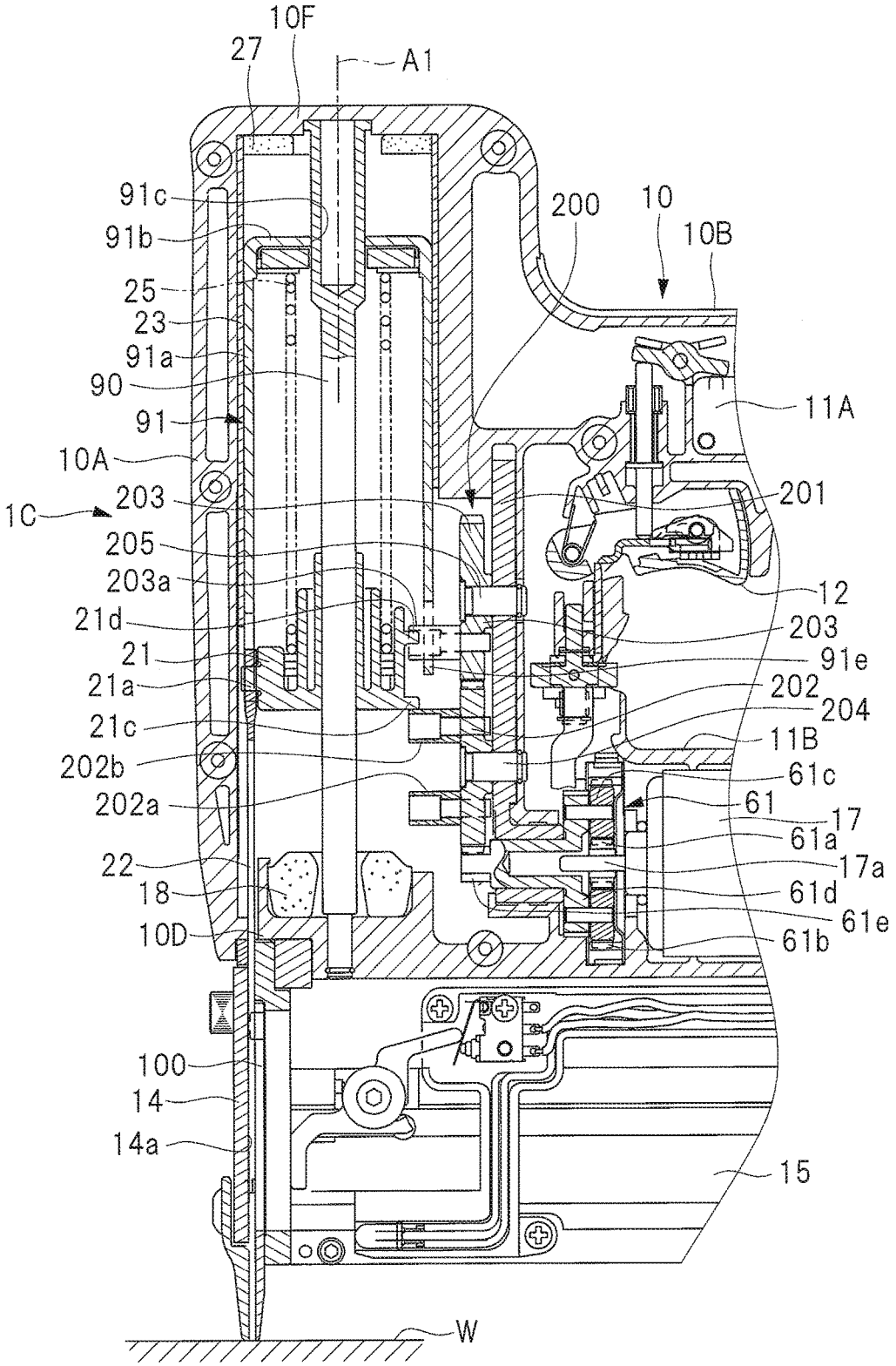

FIGS. 3(A) and 3(B) are schematic cross-sectional views of the nail driving machine of FIGS. 1 and 2;

FIG. 4 is a cross-sectional view showing a nail driving machine according to a second embodiment of the present invention;

FIG. 5 is a cross-sectional view of a part of the nail driving machine of FIG. 4;

FIGS. 6(A) and 6(B) are schematic cross-sectional views of the nail driving machine of FIGS. 4 and 5;

FIG. 7 is a cross-sectional view showing a nail driving machine according to a third embodiment of the present invention;

FIG. 8 is a cross-sectional view showing the nail driving machine according to the third embodiment of the present invention;

FIGS. 9(A), 9(B), and 9(C) are schematic cross-sectional views of the nail driving machine of FIGS. 7 and 8; and FIGS. 10(A) and 10(B) are schematic cross-sectional views of the nail driving machine of FIGS. 7 and 8.

DETAILED DESCRIPTION OF PREFERRED EMBODIMENTS (First Embodiment)

One embodiment of a fastener driving tool of the present invention will hereinafter be described in detail, referring to FIGS. 1 to 3. The fastener driving tool according to the present embodiment is a nail driving machine which drives a nail serving as a fastener into a workpiece such as wood and gypsum board by a driver blade to be driven reciprocally.

A nail driving machine 1C shown in FIGS. 1 and 2 includes a housing 10 made of a resin such as nylon and polycarbonate. The housing 10 has a cylindrical body 10A, a handle 10B continuously formed on a middle part in the lengthwise direction of the body 10A, a motor housing 11B extending laterally from one end in the lengthwise direction of the body 10A, and a mounting portion 10C connecting an end portion of the handle 10B to an end portion of the motor housing 11B.

The motor housing 11B houses therein an electric motor 17 serving as a power source. The electric motor 17 has an output shaft 17*a*, which is equipped with a first pulley 41. The handle 10B has a trigger switch 12 provided thereon to be operated by a worker. A switch mechanism 11A is disposed inside the handle 10B and is switched on and off by operating the trigger switch 12. Meanwhile, a battery 13 is attachable to the mounting portion 10C. The battery 13 has a plurality of battery cells stored in a storage case, which is provided with a battery-side terminal. The battery-side terminal is connected to a plurality of the battery cells. The mounting portion 10C is provided with a body-side terminal, and when the battery 13 is mounted to the mounting portion 10C, the battery-side terminal is connected to the body-side terminal. Further, the mounting portion 10C has a power source control unit 19 disposed therein, which is connected to the body-side terminal. Further, cables 20 which connect the power control unit 19 to the switch mechanism 11A are provided, and other cables 20 which connect the electric motor 17 to the power control unit 19 are also provided.

Meanwhile, a wall 10D is formed on the one end in the lengthwise direction of the body 10A and is equipped with a nose portion 14. The nose portion 14 is extended in the lengthwise direction of the body 10A and has an injection outlet 14*a*. A magazine 15 which extends in the same direction in which the motor housing 11B extends is disposed at the side of the nose portion 14. The magazine 15 holds a plurality of nails 100 therein aligned and connected to one another. A supply path for transferring the nails 100 is provided between the magazine 15 and the nose portion 14, so that the nails 100 held inside the magazine 15 are supplied to the injection outlet 14*a* through the supply path.

A partition wall 10E is formed inside the body 10A. The partition wall 10E has an opening 28. A cylindrical cylinder 23 with an axis A1 as a center is disposed between the wall 10D and the partition wall 10E inside the body 10A. FIGS. 1 and 2 depict a state where the axis A1 is substantially vertical. An annular weight bumper 27 with the axis A1 as a center is fixed to the side of partition wall 10E that is closer to the cylinder 23. Also, a weight 91 is disposed inside the cylinder 23. The weight 91 is formed integrally from a metal material and is capable of reciprocating in a direction along the axis A1. The weight 91 has a cylindrical portion 91*a* and a bottom portion 91*b* closing one end of the cylindrical portion 91*a*. The cylindrical portion 91*a* is provided with the axis A1 as a center. The bottom portion 91*b* has a hole 91*c* penetrating therethrough. Moreover, the center of gravity of the weight 91 is located on the axis A1. The inner peripheral surface of the cylinder 23 can be coated with a thin metal film to reduce sliding resistance between the cylinder 23 and the weight 91.

Moreover, a plunger 21 capable of moving along the axis A1 is disposed inside the weight 91. The plunger 21 has a driver blade 22 mounted to the side of plunger 21 that is closer to the wall 10D. The driver blade 22 is formed by molding a metal material into a narrow and thin plate, and a part of the driver blade 22 in the lengthwise direction can be moved inside the injection outlet 14*a*.

The plunger 21 and the driver blade 22 can move integrally along the axis A1 parallel to the direction of driving the nails 100 in. When the plunger 21 descends in a direction of moving away from the partition wall 10E, that is, in a first direction B1, the leading nail 100 of the connected nails loaded in the magazine 15 is struck out and driven into a workpiece W. Also, the plunger 21 is capable of ascending in a direction of moving closer to the partition wall 10E, that is, in a second direction B2.

Moreover, a piston bumper 18 which comes in contact with the wall 10D is disposed inside the body 10A. The piston bumper 18 is a buffering material that alleviates impact upon descending of the plunger 21. The piston bumper 18 is made of a resin such as a soft rubber or urethane resin, and when the plunger 21 moves toward the piston bumper 18, the plunger 21 abuts on the piston bumper 18.

The weight 91 houses a metal coil spring 25 therein. The coil spring 25 is a compression spring. The plunger 21, the coil spring 25, and the weight 91 are arranged coaxially around the axis A1 serving as their center on a straight line. Also, the coil spring 25 is located between the plunger 21 and the bottom portion 91*b* of the weight 91 in the direction along the axis A1. The coil spring 25 is capable of expanding/contracting in the direction along the axis A1.

A mechanism in which the torque of the electric motor 17 is transmitted to the plunger 21 will then be described. The output shaft 17*a* can rotate around an axis perpendicular to the axis A1. Also, a second pulley 42 is disposed inside the body 10A and supported by a rotating shaft 43. The axis of the rotating shaft 43 is parallel to the axis of the output shaft 17*a*, and a power transmission belt 45 is wound around the first and the second pulleys 41 and 42.

Moreover, a gear 50*a* that rotates integrally with the rotating shaft 43 is provided. A gear 92*c* supported by a rotating shaft 92*b* is disposed inside the body 10A, and the gear 50*a* and the gear 92*c* engage with each other. Further, the rotating shaft 92*b* is equipped with a gear 92*d*. Still further, a driving shaft 71 is disposed inside the body 10A. The axis of the driving shaft 71 is parallel to the axis of the rotating shaft 92*b*. The driving shaft 71 is equipped with a gear 50*b*, which is engaged with the gear 92*d*. These sets of gears 50*a* and 92*c*, gears 92*d* and 50*b*, and the like make up a speed reduction mechanism 50. Specifically, the rotating speed of the driving shaft 71 becomes lower than that of the rotating shaft 43.

Also, a guide plate 93 is disposed inside the body 10A. The guide plate 93 is fixed so as not to rotate. The guide plate 93 has a shaft hole 93*a* provided therein, and the driving shaft 71 is rotatably inserted in the shaft hole 93*a*. The guide plate 93 has a guide slot provided thereon. The guide slot is track-shaped and formed eccentric to the driving shaft 71. In the guide slot, a power transmission pin 92*f* is provided such that the power transmission pin 92*f* can move around the periphery of the driving shaft 71 along the guide slot. The power transmission pin 92*f* can also move in the guide slot in the radius direction of a circle around the driving shaft 71.

A pin support member 92*g* that integrally rotates with the driving shaft 71 is provided. The pin support member 92*g* has a slit, along which the power transmission pin 92*f* can move in the radius direction. Also, on the outer periphery of the driving shaft 71, a cylindrical drum hook 73 is attached. The drum hook 73 can rotate relatively to the driving shaft 71. The drum hook 73 has a claw, and when the power transmission pin 92*f* moves in the radius direction, the power transmission pin 92*f* engages with or disengages from this claw. A drum 70 fixed to the drum hook 73 is provided, and one end of a wire 72 is fixed to the drum 70. Apart of the outer periphery of the drum 70 is located in the opening 28. The wire 72 is extended through the opening 28 and the hole 91*c* and has the other end fixed to the plunger 21.

Figure 3:
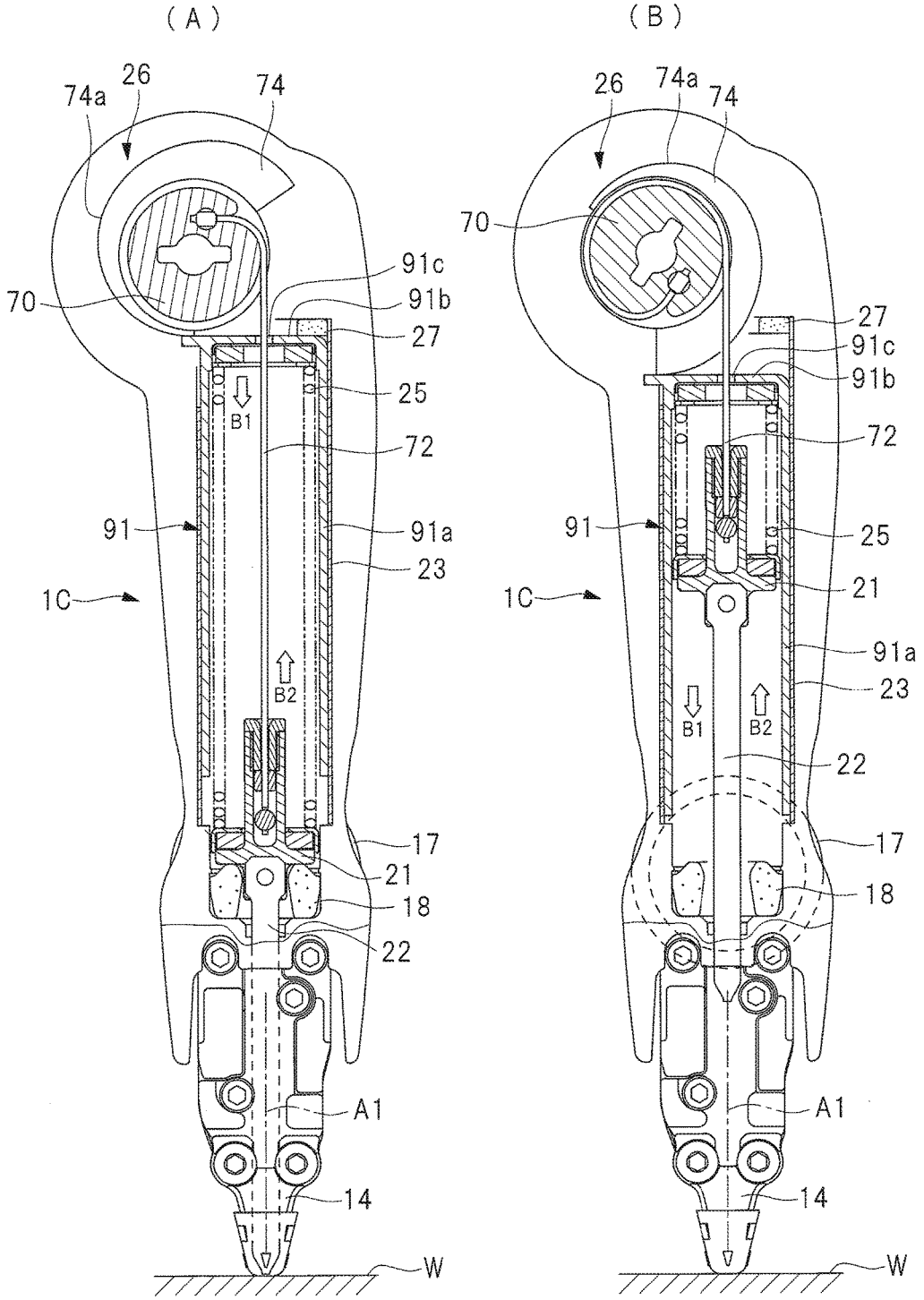

Then, in FIG. 3, when the drum 70 rotates counterclockwise, the wire 72 is reeled up by the drum 70, causing the plunger 21 to move in a direction along the axis A1, specifically, in a direction of moving closer to the partition wall 10E. In other words, the drum 70 and the wire 72 work as a winch mechanism.

The above-described guide plate 93, power transmission pin 92*f*, pin support member 92*g*, drum hook 73, and the like make up a clutch mechanism 60. A configuration described in, for example, Japanese Patent Application Laid-Open Publication Nos. 2008-238288 and 2010-5776 is adopted as the clutch mechanism 60.

Also, a cam 74 that integrally rotates with the drum 70 is provided. The cam 74 has a cam surface 74*a* provided on its outer periphery. The cam surface 74*a* is formed around the axis of the driving shaft 71 in a range of a given angle, specifically, in a range of less than 360 degrees. The cam surface 74*a* has different radii around the axis of the driving shaft 71 in response to different phase in the circumferential direction around the axis of the driving shaft 71. In other words, the cam surface 74*a* is curved such that when the phase in the circumferential direction changes, the cam surface 74*a* has different radii around the axis of the driving shaft 71. A part of the outer periphery of the cam 74 is located in the opening 28.

The above-described guide plate 93, power transmission pin 92*f*, pin support member 92*g*, drum hook 73, drum 70, cam 74, wire 72, and the like make up a power transmission mechanism 26. The power transmission mechanism 26 is a clutch mechanism that connects or disconnects a path for transmitting power from the electric motor 17 to the coil spring 25. The power transmission mechanism 26 also serves as movement means that moves the plunger 21 and the weight 91. The power transmission mechanism 26 converts the torque of the electric motor 17 into a compressive force applied to the coil spring 25.

The power supply control unit 19 has a CPU, RAM, and the like. Also, a microswitch which detects the position of the plunger 21, the rotation angle of the drum 70, and the like is disposed inside the housing 10. Then, the power source control unit 19 controls supply and disconnection of electric power to the electric motor 17 based on an operation of the trigger switch 12, a signal from the microswitch, and the like.

Motion and control of the nail driving machine 1C will then be described. The worker presses the tip of the nose portion 14 against the workpiece W, as shown in FIGS. 1 and 3. In this situation, when the trigger switch 12 is not operated, the switch mechanism 11A is switched off. Accordingly, electric power from the battery 13 is not supplied to the electric motor 17, and the output shaft 17*a* stops. This means that the torque of the electric motor 17 is not transmitted to the drum 70. As a result, the plunger 21 which is pushed by the elastic force of the coil spring 25 in the first direction B1 comes in contact with the piston bumper 18 and stops at a bottom dead center, as shown in FIGS. 1 and 3(A). Also, the weight 91 comes in contact with the weight bumper 27 and stops at a top dead center.

Meanwhile, when the plunger 21 is pushed by the elastic force of the coil spring 25 against the piston bumper 18 and therefore stops at the bottom dead center, the length of the wire 72 reeled out from the drum 70 is the maximum. Also, the drum 70 stops with the part of the cam surface 74*a* having the minimum radius around the axis of the driving shaft 71 being in contact with the bottom portion 91*b* of the weight 91, as shown in FIG. 3(A). In this manner, the cam 74 is positioned circumferentially relative to the drum 70 so that when the length of the wire 72 reeled out from the drum 70 becomes the maximum and the drum 70 stops, the part of the cam surface 74*a* of the cam 74 that is closest to the bottom portion 91*b* and the lower surface of the weight bumper 27 are aligned in the direction along the axis A1.

Also, when the drum 70 stops so that the part of the cam surface 74*a* of the cam 74 that is closest to the bottom portion 91*b* and the lower surface of the weight bumper 27 are aligned in the direction along the axis A1, the phase of the drum 70 in the circumferential direction around the axis of the driving shaft 71 is referred to as an initial position.

In contrast, when the trigger switch 12 is operated by the worker, the switch mechanism 11A is switched on, and electric power from the battery 13 is supplied to the electric motor 17. As a result, the output shaft 17*a* rotates in one direction, transmitting power of the output shaft 17*a* to the rotating shaft 43 via the first pulley 41, the power transmission belt 45, and the second pulley 42, so that the power transmitted to the rotating shaft 43 is transmitted to the driving shaft 71 via the speed reduction mechanism 50. Accordingly, the rotating speed of the driving shaft 71 becomes lower than that of the rotating shaft 43, and a torque transmitted from the rotating shaft 43 to the driving shaft 71 is increased.

The pin support member 92*g* integrally rotates with the driving shaft 71, causing the power transmission pin 92*f* to move along the guide slot. While the power transmission pin 92*f* is engaged with the claw of the drum hook 73, the torque of the driving shaft 71 is transmitted to the drum 70 via the power transmission pin 92*f* and the drum hook 73, causing the drum 70 to rotate in a given direction.

According to the present embodiment, in FIG. 3, the drum 70 rotates counterclockwise at a given angle from the initial position, thus reeling up the wire 72 around the drum 70. A given angle at which the drum 70 rotates is within the range of an angle in which the cam surface 74*a* is provided. As a result, the plunger 21 connected to the wire 72 ascends in the cylinder 23, as shown in FIG. 3(B). Specifically, the plunger 21 moves in the direction of moving closer to the bottom portion 91*b* of the weight 91, that is, in the second direction B2. When the plunger 21 moves in the second direction B2, a compressive force is applied from the plunger 21 to the coil spring 25, thereby accumulating elastic energy in the coil spring 25.

Moreover, in FIG. 3, while the drum 70 rotates counterclockwise at a given angle from its initial position, the radius where the part of the cam surface 74*a* comes in contact with the bottom portion 91*b* increases. As a result, an extent of the cam surface 74*a* projecting from the lower surface of the weight bumper 27 increases, which causes the weight 91 to move in the first direction B1 against the elastic force of the coil spring 25. This means that the bottom portion 91*b* of the weight 91 moves away from the weight bumper 27.

In this manner, while the drum 70 rotates counterclockwise at a given angle from its initial position, the plunger 21 moves in the second direction B2, and the weight 91 moves in the first direction B1. As a result, the compression amount of the coil spring 25 interposed between the plunger 21 and the weight 91 increases.

Then, at the point when the drum 70 has rotated counterclockwise at a given angle from its initial position, the power transmission pin 92*f* is separated from the claw of the drum hook 73. This means that the clutch mechanism 60 is in a disengaged state, in which power from the driving shaft 71 is not transmitted any longer to the drum 70. As a result, the drum 70 stops temporarily at the position shown in FIG. 3(B), and the plunger 21 stops as well. As described above, the plunger 21 moves in the second direction B2, so that the drum 70 stops and the position at which the plunger 21 then stops is referred to as a top dead center. When the drum 70 stops, the weight 91 having been pushed by the cam surface 74*a* also stops. This position at which the weight 91 having been pushed by the cam surface 74*a* stops after the drum 70 stops is referred to as a bottom dead center. Also, the position of the drum 70 in the rotational direction at which the drum 70 stops because power is not transmitted from the driving shaft 71 is referred to as a return position.

When power from the driving shaft 71 is not transmitted to the drum 70, the plunger 21 moves rapidly in the first direction B1 by the repulsive force of the coil spring 25. When the plunger 21 moves in the first direction B1, the wire 72 is pulled by the plunger 21. As a result, the drum 70 rotates clockwise from the return position. When the drum 70 rotates clockwise, the radius defined by the part of the cam surface 74*a* which comes in contact with the bottom portion 91*b* becomes smaller. In other words, the clockwise rotation of the drum 70 reduces the pushing force to the weight 91 in the first direction B1. As a result, the weight 91 moves in the second direction B2 by the repulsive force of the coil spring 25.

Meanwhile, before the plunger 21 moves in the first direction B1, the nail 100 is transferred from the magazine 15 to the injection outlet 14*a*, and when the plunger 21 moves in the first direction B1, the driver blade 22 strikes the nail 100 to be driven into the workpiece W. When the driver blade 22 strikes the nail 100, the plunger 21 comes in contact with the piston bumper 18 and stops at the bottom dead center. When the plunger 21 stops at the bottom dead center, the traction force on the wire 72 is released, so that the drum 70 stops at the initial position shown in FIG. 3(A). Moreover, being synchronized with the stopping movement of the plunger 21 at the bottom dead center, the bottom portion 91*b* of the weight 91 comes in contact with the weight bumper 27 and stops at the top dead center.

When the nail 100 is driven in, electric power supply to the electric motor 17 is stopped temporarily even if an operating force is applied to the trigger switch 12. For this reason, no power is transmitted from the driving shaft 71 to the drum 70 during a period in which the drum 70 shifts from the return position back to the initial position. Then, when the operating force to the trigger switch 12 is released temporarily and then the trigger switch 12 is operated again, the above-described same control and motion are carried out.

In this manner, according to the nail driving machine 1C shown in FIGS. 1 to 3, a compressive force is applied to the coil spring 25 first, and then the compressive force which is applied to the coil spring 25 is released to allow the plunger 21 to move in the first direction B1 due to the repulsive force of the coil spring 25, so that the nail 100 is driven into the workpiece W. Moreover, as the plunger 21 moves in the first direction B1 to drive the nail 100 in, the weight 91 concurrently moves in the second direction B2 reverse to the first direction B1. In other words, the plunger 21 and the driver blade 22 move in the direction reverse to the direction in which the weight 91 moves along the axis A1. As a result, reaction generated when the plunger 21 moves in the first direction B1 to drive the nail 100 in is absorbed or offset by backlash generated when the weight 91 moves in the second direction B2. Hence, the vibration of the nail driving machine 1C, especially the vibration of the housing 10 can be reduced or suppressed.

Also, this is a structure which causes the plunger 21 to move in the first direction B1 and the weight 91 to move in the second direction B2 due to the repulsive force of the single coil spring 25. Specifically, this is the structure which causes the plunger 21 and the weight 91 to move due to the repulsive force of the physically same coil spring 25. In other words, in this structure, the element that moves the plunger 21 and the weight 91 is shared. Hence, an increase in the number of components of the nail driving machine 1C can be prevented, so that the size and the weight of the nail driving machine 1C can be reduced.

In addition, the weight 91 is of a cylindrical structure, and the plunger 21 moves along the axis A1 inside the weight 91. The weight 91 thus plays a role of guiding the direction of expansion/contraction of the coil spring 25. Moreover, in the radius direction of a circle around the axis A1, the plunger 21 and the coil spring 25 are arranged inside the cylindrical portion 91*a* of the weight 91. Hence, this structure prevents an increase in the size of the nail driving machine 1C in the direction along the axis A1 and also allows the weight of the weight 91 to be sufficiently secured.

The movement stroke and mass of the weight 91, the spring constant of the coil spring 25, the shape of the cam surface 74*a*, and the like can be designed so that a time taken from the point when the plunger 21 starts to descend in the first direction B1 from the top dead center to the point when the driver blade 22 finishes striking the nail 100 matches a time taken from the point when the weight 91 starts to ascend in the second direction B2 from the bottom dead center to the point when the weight 91 comes in contact with the weight bumper 27 and stops at the top dead center. By designing as described above, the reaction generated upon striking the nail 100 with the driver blade 22 can be certainly reduced.

Further, the plunger 21 and the weight 91 can move relatively to each other in the direction along the axis A1. Accordingly, even if the nail 100 gets stuck at the injection outlet 14*a* to cause the driver blade 22 to stop, the weight 91 can be moved in the second direction B2 by the repulsive force of the coil spring 25. At this time, the wire 72 is not pulled by the weight 91, and application of a load to a connecting part between the wire 72 and the plunger 21 can be prevented.

(Second Embodiment)

Figure 6:
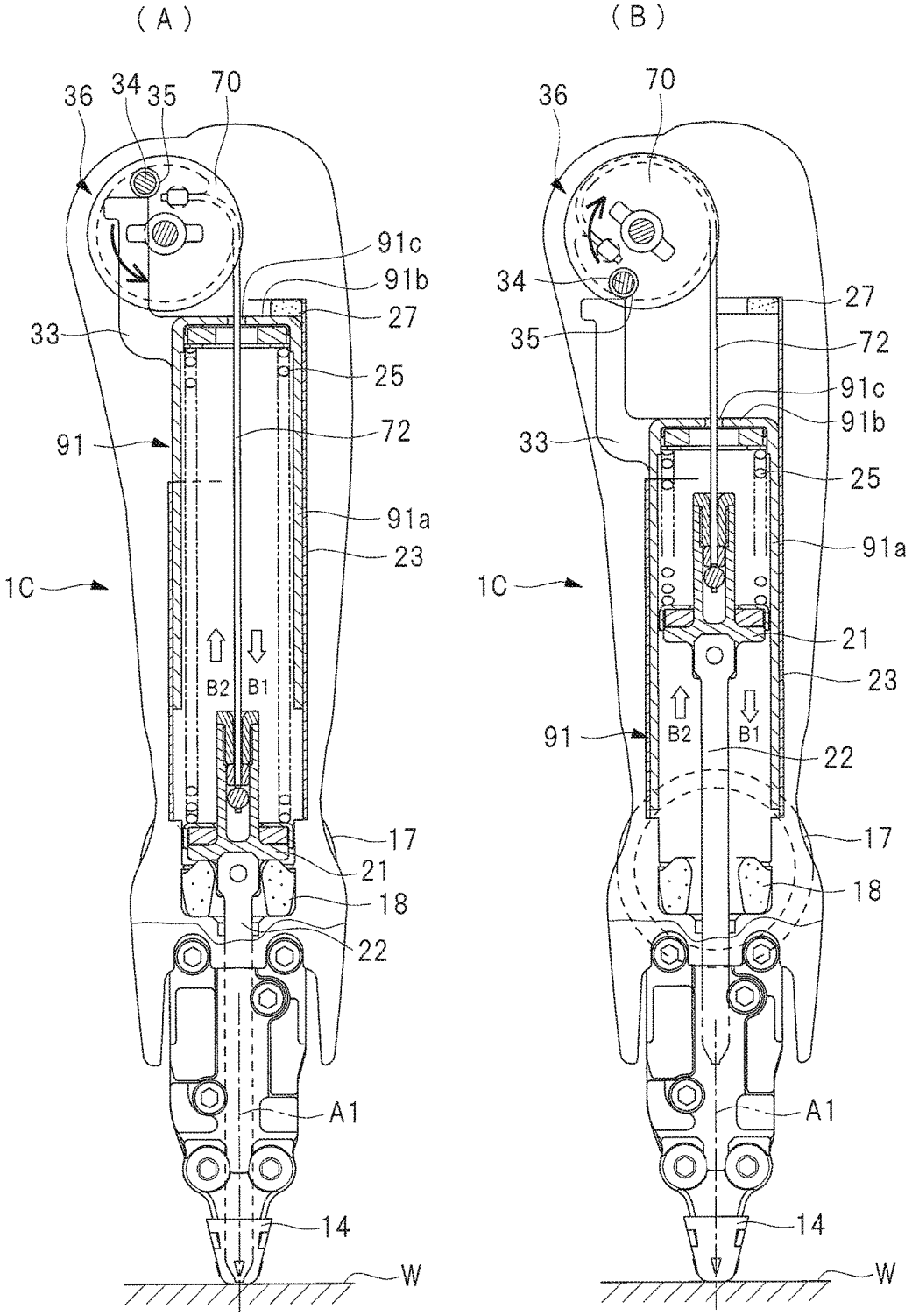

A second embodiment of the nail driving machine 1C will then be described, referring to FIGS. 4 to 6. In FIGS. 4 to 6, the same constituent elements as depicted in FIGS. 1 to 3 are denoted by the same reference numerals. Also, in FIGS. 4 and 5, the configuration of the battery, power source control unit, and the like is omitted. Comparing the nail driving machine 1C of the first embodiment with the nail driving machine 1C of the second embodiment, the mechanism that causes the weight 91 to move in the first direction B1 is different. The nail driving machine 1C of the second embodiment has an engaging portion 33 provided on the weight 91. The engaging portion 33 is extended in the direction along the axis A1 from the weight 91, and a part of the engaging portion 33 is located in the opening 28. The engaging portion 33 moves integrally with the weight 91 in the direction along the axis A1. The engaging portion 33 is made of a metal and the like.

In contrast, according to the second embodiment, the cam 74 is not provided, but the drum 70 is provided with a support pin 34. The support pin 34 is disposed at a position at which the support pin 34 is eccentric to the driving shaft 71. Also, the support pin 34 has a cylindrical roller 35 fitted to its outer periphery. The roller 35 is fitted to the support pin 34 such that the roller 35 can rotate relative to the support pin 34. The support pin 34 is located at a position at which when the drum 70 rotates within the range of a given angle along a circumference around the driving shaft 71, the outer peripheral surface of the roller 35 always comes in contact with the engaging portion 33 regardless of the position of the drum 70 in the rotational direction. The drum 70, the wire 72, the support pin 34, the roller 35, the engaging portion 33, and the like make up a power conversion mechanism 36.

Motion and control of the nail driving machine 1C of the second embodiment will then be described. First, the worker presses the tip of the nose portion 14 against the workpiece W. When the trigger switch 12 is not operated, the electric motor 17 is off, so that no power is transmitted to the driving shaft 71. As a result, as shown in FIGS. 4 and 6(A), the plunger 21 stops at the bottom dead center. When the plunger 21 stops at the bottom dead center, the weight 91 is pushed by the repulsive force of the coil spring 25 to come in contact with the weight bumper 27, thus stopping at the top dead center. Meanwhile, the roller 35 comes in contact with the tip of the engaging portion 33, causing the drum 70 to stop at its initial position. At this time, the roller 35 is located above the lowest part of the outer peripheral surface of the drum 70.

Then, when the trigger switch 12 is operated to cause the output shaft 17*a* of the electric motor 17 to rotate, power from the output shaft 17*a* is transmitted to the driving shaft 71 in the same manner as in the first embodiment. According to the same principle as in the first embodiment, when the driving shaft 71 rotates, the drum 70 rotates counterclockwise from the initial position in the range of a given angle in FIG. 6. The range of a given angle in which the drum 70 rotates is equivalent to the range in which the roller 35 moves from the stop position to reach the lowest part of the outer peripheral surface of the drum 70. In other words, the rotation angle of the drum 70 is smaller than 180 degrees.

When the drum 70 rotates counterclockwise, the plunger 21 moves in the second direction B2. Also, when the drum 70 rotates counterclockwise, the roller 35 revolves on the circumference around the driving shaft 71 in the range of a given angle. As a result, the roller 35 pushes the engaging portion 33 in the direction along the axis A1, which causes the weight 91 to move in the first direction B1 against the repulsive force of the coil spring 25. In this manner, when the plunger 21 moves in the second direction B2 and the weight 91 moves in the first direction B1, a compressive force is added to the coil spring 25.

Then, in the same manner as in the first embodiment, at the point when the drum 70 has rotated counterclockwise at a given angle from the initial position, power from the driving shaft 71 is not transmitted any longer to the drum 70. As a result, the drum 70 stops temporarily at the position shown in FIG. 6(B), and the plunger 21 also stops. When the drum 70 stops, the weight 91 which has been pushed by the roller 35 also stops.

When power from the driving shaft 71 is not transmitted to the drum 70, the plunger 21 moves rapidly in the first direction B1 by the repulsive force of the coil spring 25. When the plunger 21 moves in the first direction B1, the wire 72 is pulled by the plunger 21. As a result, the drum 70 rotates clockwise from the return position. When the drum 70 rotates clockwise, the pressing force of the roller 35 which is applied to the weight 91 decreases. As a result, the weight 91 moves in the second direction B2 by the repulsive force of the coil spring 25.

In this manner, the plunger 21 moves in the first direction B1 to drive the nail 100 into the workpiece W in the same manner as in the first embodiment and comes in contact with the piston bumper 18 to stop at the bottom dead center. When the plunger 21 stops, the traction force on the wire 72 is released, causing the drum 70 to stop at the initial position shown in FIG. 6(A). Moreover, being synchronized with the stopping movement of the plunger 21 at the bottom dead center, the bottom portion 91*b* of the weight 91 comes in contact with the weight bumper 27 and stops at the top dead center.

Also, when the nail 100 is driven in, power supply to the electric motor 17 is stopped temporarily even if an operating force is applied to the trigger switch 12. Then, when the operating force to the trigger switch 12 is released temporarily and then the trigger switch 12 is operated again, the above-described control and motion are carried out.

The same constituent elements of the nail driving machine 1C of the second embodiment as those of the nail driving machine 1C of the first embodiment achieve the same effects as obtained by the constituent elements of the nail driving machine 1C of the first embodiment. Moreover, according to the nail driving machine 1C of the second embodiment, when the drum 70 rotates to cause the weight 91 to move in the direction along the axis A1, the roller 35 rolls while being in contact with the engaging portion 33. As a result, a contact part between the roller 35 and the engaging portion 33 is in a state of rolling friction, which suppresses an increase in frictional resistance.

Accordingly, when power from the electric motor 70 is transmitted to the drum 70 to rotate the drum 70 and move the weight 91 in the first direction B1, power loss can be suppressed. In contrast, when the weight 91 moves in the second direction B2 by the repulsive force of the coil spring 25, the movement of the weight 91 is not hampered, which suppresses a decrease in the function of absorbing the reaction generated upon driving the nail 100 in. In addition, wear or deformation of the contact part between the roller 35 and the engaging portion 33 is suppressed, which improves the durability of the power conversion mechanism 36.

(Third Embodiment)

A third embodiment of the present invention will be described, referring to FIGS. 7 to 10. The same constituent elements of the nail driving machine 1C of the third embodiment as those of the nail driving machine 1C of the first embodiment are denoted by the same reference numerals used in FIGS. 1 and 3. In FIGS. 7 and 8, the configuration of the battery, power supply control unit, and the like is omitted. According to the nail driving machine 1C of the third embodiment, the housing 10 has a wall 10F disposed at a given interval from the wall 10D. Here, a given gap is a gap in the direction along the axis A1.

A guide shaft 90 is disposed inside the body 10A, where one end of the guide shaft 90 is fixed to the wall 10F and the other end of the guide shaft 90 is fixed to the wall 10D. The guide shaft 90 is set coaxial with the cylinder 23, and a part of the guide shaft 90 in the lengthwise direction is located in the cylinder 23. To the inner surface of the wall 10F, the annular weight bumper 27 is fixed. The weight bumper 27 is disposed so as to encircle the exterior of the guide shaft 90. In addition, the piston bumper 18 attached to the wall 10D is also disposed so as to encircle the exterior of the guide shaft 90.

The weight 91 is disposed inside the cylinder 23 and has the hole 91*c* in which the guide shaft 90 is inserted. The weight 91 is capable of moving in the direction along the axis A1 in the cylinder 23 and is capable of moving relatively to the guide shaft 90 in the direction along the axis A1.

Moreover, the guide shaft 90 has the plunger 21 fitted on its outer periphery. The plunger 21 is capable of moving in the direction along the axis A1 relative to the guide shaft 90. Further, the coil spring 25 is placed in the cylinder 23, specifically, in the cylindrical portion 91*a* of the weight 91.

Also, on the side of the plunger 21, a connecting portion 21*a* is formed. The connecting portion 21*a* projects in a direction crossing the axis A1. Then, one end of the driver blade 22 in the lengthwise direction is connected to the connecting portion 21*a*. Because of this structure, when the plunger 21 moves in the direction along the axis A1, the driver blade 22 also moves with the plunger 21. The driver blade 22 of the third embodiment is located at a position separated from the axis A1 of the plunger 21.

According to the nail driving machine 1C of the third embodiment, a speed reduction mechanism 61 and a driving cam 200 are provided on a path through which power from the electric motor 17 is transmitted to the weight 91 and the plunger 21. The speed reduction mechanism 61 and the driving cam 200 are arranged between the electric motor 17 and the guide shaft 90. The speed reduction mechanism 61 is composed of a single-pinion type planetary gear mechanism and has a sun gear 61*a* fixed to the output shaft 17*a*, a ring gear 61*b* disposed in the housing 10 and set coaxial with the sun gear 61*a*, and a carrier 61*d* supporting pinion gears 61*c* engaged with the sun gear 61*a* and with the ring gear 61*b* to allow the pinion gears 61*c* to rotate and revolve. The ring gear 61*b* is fixed to the housing 10. The carrier 61*d* is provided with a gear 61*e*.

The driving cam 200 has a first gear 202 and a second gear 203. A gear holder 201 is fixed to the housing 10, a support shaft 204 attached to the gear holder 201 supports the first gear 202 to allow it to rotate, and a support shaft 205 attached to the gear holder 201 supports the second gear 203 to allow it to rotate. In the direction along the axis A1, the support shafts 204 and 205 are arranged between the gear 61*e* and the weight bumper 27. In the direction along the axis A1, the support shaft 204 is disposed between the support shaft 205 and the gear 61*e*.

Also, the first gear 202 and the second gear 203 are identical in the number of teeth and are engaged with each other, and the first gear 202 is engaged with the gear 61*e*. Moreover, the first gear 202 is provided with two cam rollers 202*a* and 202*b*. The cam rollers 202*a* and 202*b* are located at a position at which the cam rollers 202*a* and 202*b* are eccentric to the support shaft 204. Further, the cam rollers 202*a* and 202*b* are arranged on the same circumference around the support shaft 204. The cam rollers 202*a* and 202*b* are capable of rotating, respectively, relative to the first gear 202. The second gear 203 is fitted with a cam roller 203*a*. The cam roller 203*a* is located at a position at which the cam roller 203*a* is eccentric to the support shaft 205. The cam roller 203*a* is capable of rotating relative to the second gear 203.

Also, the plunger 21 is provided with a first locking portion 21*c* and a second locking portion 21*d*. In the direction along the axis A1, the first locking portion 21*c* is disposed between the second locking portion 21*d* and the piston bumper 18. Moreover, a cutout 91*d* is formed on one end of the cylindrical portion 91*a* of the weight 91, at which a first engaging projection 91*e* extending in the circumferential direction of the cylindrical portion 91*a* is formed.

Operation, control, and motion of the nail driving machine 1C of the third embodiment will then be described. First, when the trigger switch 12 is not operated, the electric motor 17 is off. Moreover, as shown in FIGS. 7 and 9(A), the plunger 21 is pressed against the piston bumper 18 by the repulsive force of the coil spring 25 to stop at the bottom dead center, and the weight 91 is pressed against the weight bumper 27 to stop at the top dead center. Further, the cam roller 202*a* is not locked on the second locking portion 21*d*, and the cam roller 202*b* is not engaged with the first locking portion 21*c*. Still further, the cam roller 203*a* is not engaged with the first engaging projection 91*e*.

Then, when the front end of the nose portion 14 is pressed against the workpiece W and the trigger switch 12 is operated, power is supplied to the electric motor 17, causing the output shaft 17*a* to rotate. When the output shaft 17*a* rotates, that is, when a torque is input to the sun gear 61*a*, in the speed reduction mechanism 61, the ring gear 61*b* receives backlash, and the carrier 61*d* outputs a torque. In this case, the rotating speed of the carrier 61*d* becomes lower than that of the sun gear 61*a*, so that the carrier 61*d* increases the torque.

Figure 9:
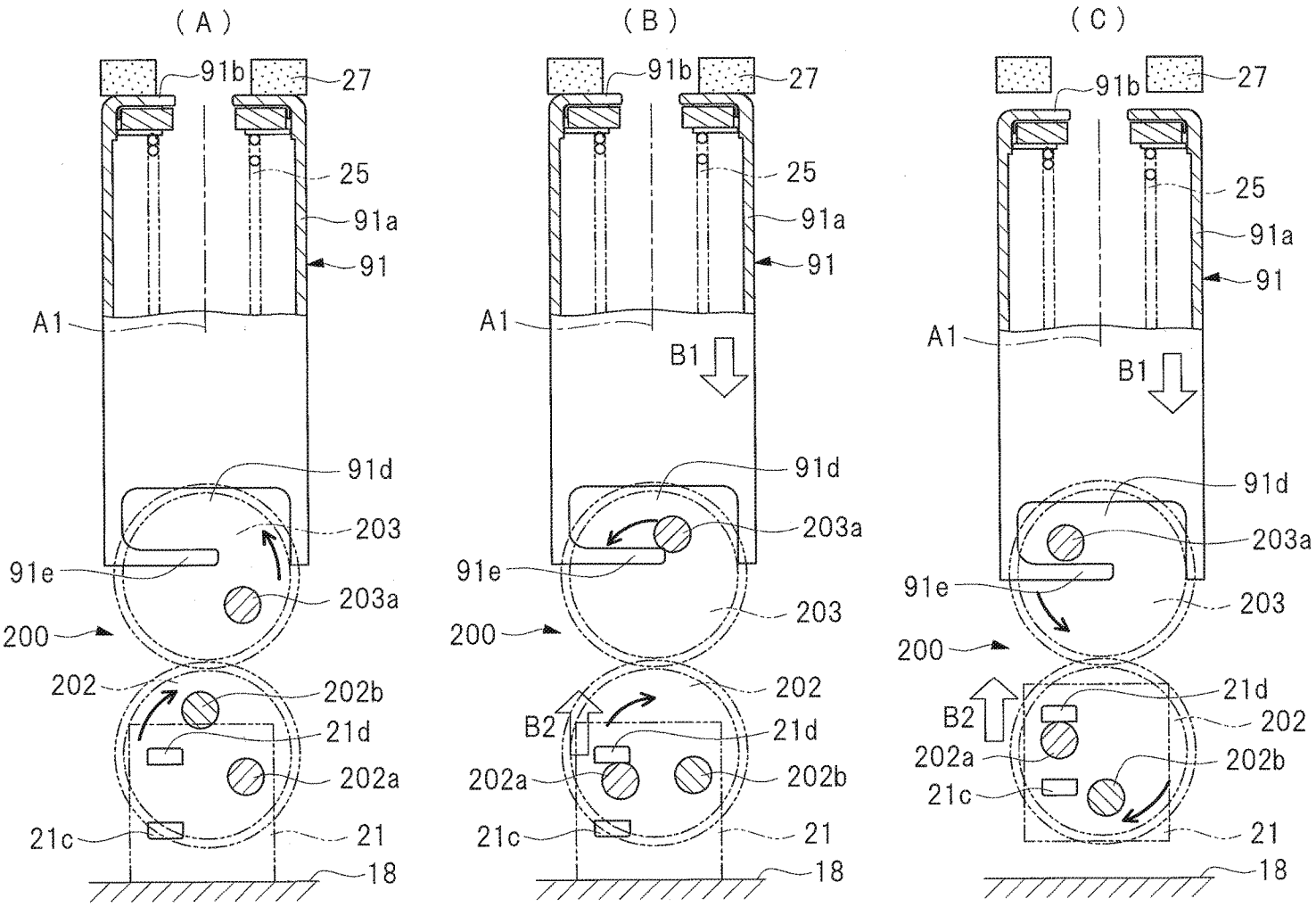
Figure 10:
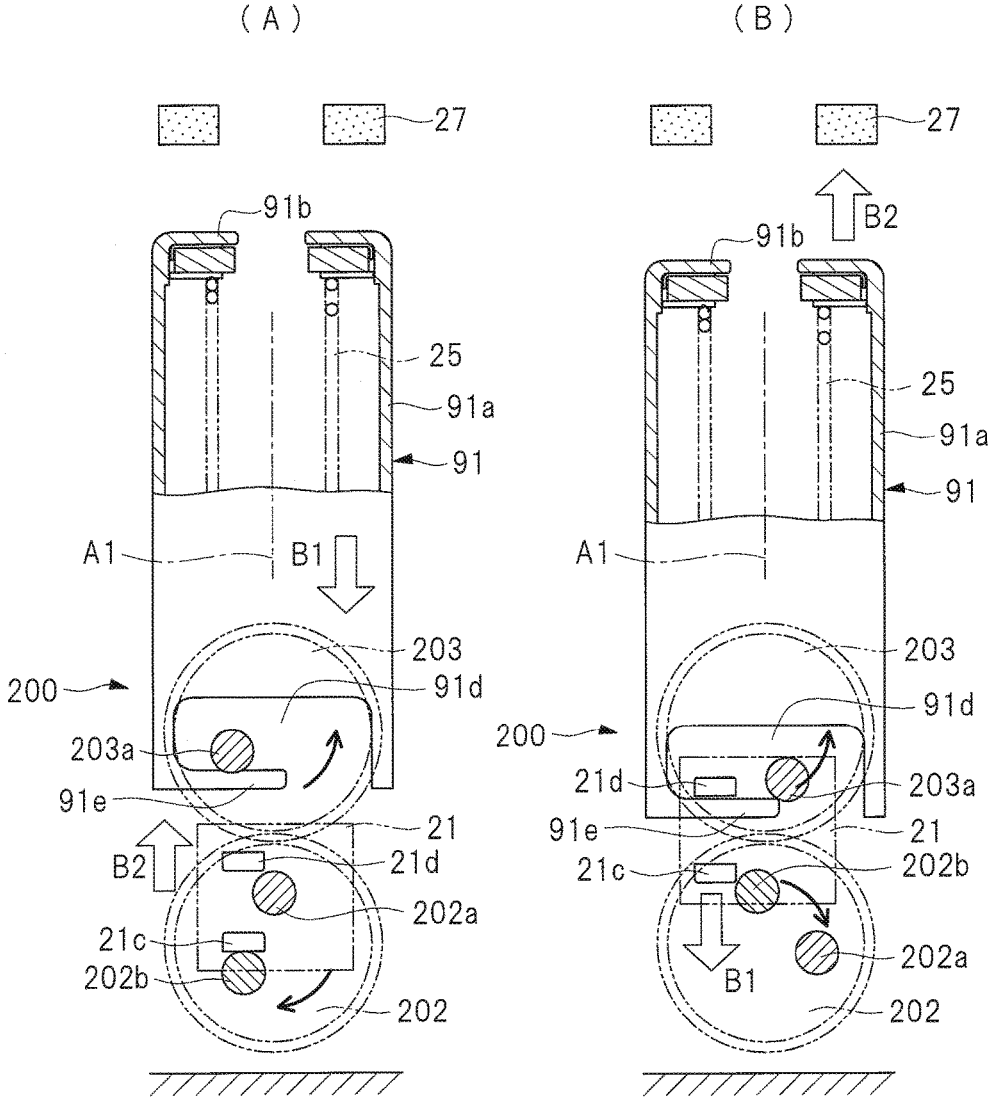

The torque transmitted to the carrier 61*d* is transmitted to the second gear 203 via the gear 61*e* and the first gear 202. According to the nail driving machine 1C of the third embodiment, the first gear 202 rotates clockwise, and the second gear 203 rotates counterclockwise, as shown in FIG. 9. Then, as shown in FIG. 9(B), when the cam roller 202*a* is locked on the second locking portion 21*d*, the plunger 21 moves in the second direction B2 against the repulsive force of the coil spring 25. As a result, the plunger 21 moves away from the piston bumper 18, as shown in FIG. 9(C).

Moreover, when the cam roller 203*a* proceeds into the cutout 91*d* and engages with the first engaging projection 91*e*, the weight 91 moves in the first direction B1 against the repulsive force of the coil spring 25. Accordingly, the weight 91 moves away from the weight bumper 27, as shown in FIG. 9(C). In this manner, the plunger 21 and the weight 91 simultaneously move in the opposite directions and approach each other, thus applying a compressive force to the coil spring 25.

When the electric motor 17 keeps rotating to further rotate the first and the second gears 202 and 203, the bottom portion 91*b* of the weight 91 moves further away from the weight bumper 27, as shown in FIG. 10(A). Meanwhile, the cam roller 202*a* moves away from the second locking portion 21*d*, and the cam roller 202*b* is locked on the first locking portion 21*c*. As a result, power from the second gear 203 is transmitted through the cam roller 202*b* to the plunger 21, causing the plunger 21 to move continuously. Hence, the compressive force is applied further to the coil spring 25.

Further, when the electric motor 17 keeps rotating to rotate the first and the second gears 202 and 203 as shown in 10(B), the cam roller 203*a* moves away from the first engaging projection 91*e*, and the cam roller 202*b* moves away from the first locking portion 21*c*. As a result, power from the first gear 202 is not transmitted any longer to the plunger 21, and power from the second gear 203 is not transmitted any longer to the weight 91. Hence, the plunger 21 moves rapidly in the first direction B1 by the repulsive force of the coil spring 25, and the weight 91 moves rapidly in the second direction B2 by the repulsive force of the coil spring 25. When the plunger 21 moves in the first direction B1, the driver blade 22 strikes the nail 100, and the nail 100 is driven into the workpiece W. In synchronization with the nail 100 being struck, the weight 91 hits the weight bumper 27 and stops at the top dead center.

After the nail 100 is struck in the above-described manner, the electric motor 17 is stopped temporarily even if the trigger switch 12 is operated. As a result, as shown in FIG. 9(A), the second gear 203 stops with the cam roller 203*a* being separated from the first engaging projection 91*e*, and the first gear 202 stops with the cam roller 202*a* and the cam roller 202*b* being separated from the second locking portion 21*d* and the first locking portion 21*c*, respectively.

Note that the power source control unit 19 controls timing of stopping the electric motor 17 after the nail 100 is struck based on the position of the plunger 21 and the rotation angle from the positon at which the electric motor 17 starts to rotate. Then, when the operating force to the trigger switch 12 is temporarily released and the trigger switch 12 is operated again, power is supplied to the electric motor 17.

As described above, according to the nail driving machine 1C of the third embodiment, when the nail 100 is struck and driven into the workpiece W, the plunger 21 and the weight 91 move in the directions opposite to each other in the same manner as in the nail driving machine 1C of the first embodiment. The nail driving machine 1C of the third embodiment thus achieves the same effect as obtained by the nail driving machine 1C of the first embodiment. Also, the nail driving machine 1C of the third embodiment has a structure in which the repulsive force of the single coil spring 25 allows the plunger 21 to move in the first direction B1 and the weight 91 to move in the second direction B2. Accordingly, the nail driving machine 1C of the third embodiment achieves the same effect as obtained by the nail driving machine 1C of the first embodiment.

Moreover, the weight 91 is of a cylindrical structure, and the plunger 21 moves along the axis A1 inside the weight 91. The nail driving machine 1C of the third embodiment thus achieves the same effect as obtained by the nail driving machine 1C of the first embodiment.

Further, according to the nail driving machine 1C of the third embodiment, the movement stroke and the mass of the weight 91, the spring constant of the coil spring 25, and the like can be designed so that a time taken from the point when the plunger 21 starts to move in the first direction B1 from the top dead center to the point when the driver blade 22 finishes striking the nail 100 matches a time taken from the point when the weight 91 starts to move in the second direction B2 from the bottom dead center to the point when the weight 91 comes in contact with the weight bumper 27 and stops at the top dead center.

Still further, according to the nail driving machine 1C of the third embodiment, the plunger 21 and the weight 91 are capable of moving relatively to each other in the direction along the axis A1. The nail driving machine 1C of the third embodiment thus achieves the same effect as obtained by the nail driving machine 1C of the first embodiment.

The plunger 21 and driver blade 22 described in each embodiment are equivalent to operating members of the present invention, the nail 100 is equivalent to a fastener of the present invention, and the direction along the axis A1 is equivalent to a given direction of the present invention. In the first embodiment, the drum 70 is equivalent to a first rotating member. Moreover, in the first and the second embodiments, a state in which the power transmission pin 92*f* and the drum hook 73 are engaged with each other is a first state of the present invention, and a state in which the power transmission pin 92*f* and the drum hook 73 are separated from each other is a second state of the present invention. Further, in the first embodiment, the drum 70 and the wire 72 are equivalent to a first mechanism of the present invention, and the drum 70 is equivalent to a reeling member of the present invention. In the first embodiment, the drum 70 and the cam 74 are equivalent to a second mechanism of the present invention.

Still further, in the second embodiment, the drum 70 and the wire 72 are equivalent to the first mechanism of the present invention, and the drum 70 is equivalent to the reeling member of the present invention. In the second embodiment, the engaging portion 33, the support pin 34, the roller 35, and the drum 70 are equivalent to the second mechanism of the present invention. In the second embodiment, the drum 70 is equivalent to a second rotating member, and the roller 35 is equivalent to a roller of the present invention.

Meanwhile, in the third embodiment, the driving cam 200 is equivalent to a power conversion mechanism of the present invention. Moreover, in the third embodiment, a state in which the cam roller 202*a* is engaged with the second locking portion 21*d* or the cam roller 202*b* is engaged with the first locking portion 21*c* and the cam roller 203*a* is engaged with the first engaging projection 91*e* is the first state of the present invention. In the third embodiment, a state in which the cam roller 202*a* is separated from the second locking portion 21*d*, the cam roller 202*b* is separated from the first locking portion 21*c*, and the cam roller 203*a* is separated from the first engaging projection 91*e* is the second state of the present invention.

In the third embodiment, the first gear 202 and the cam rollers 202*a* and 202*b* are equivalent to the first mechanism of the present invention, and the second gear 203 and the cam roller 203*a* are equivalent to the second mechanism of the present invention. In the third embodiment, the first gear 202 is equivalent to a third rotating member of the present invention, the cam rollers 202*a* and 202*b* are equivalent to first engaging portions of the present invention, and the first and the second locking portions 21*c* and 21*d* are equivalent to second engaging portions of the present invention. The second gear 203 is equivalent to a fourth rotating member of the present invention, the cam roller 203*a* is equivalent to a third engaging portion of the present invention, and the first engaging projection 91*e* is equivalent to a fourth engaging portion of the present invention.

The present invention is not limited to the foregoing embodiments and various modifications and alterations can be made within the scope of the present invention. For example, the fastener driven by the fastener driving tool of the present invention into the workpiece includes not only the nail but also a tucker, pin, and the like. Moreover, the elastic mechanism of the present invention includes not only the metal spring but also an air spring, rubber-based elastic material, and the like. Not only the single metal spring but also a plurality of metal springs may be used. What is required is a structure in which the repulsive forces of a plurality of springs are applied collectively to the operating member and the weight. In each embodiment, the rotational directions of rotating elements such as the drum, the first gear, and the second gear are described as the clockwise direction and the counterclockwise direction, while, if the rotating elements are observed from the opposite side, the relationship between the clockwise direction and the counterclockwise direction is reversed.

Further, the fastener driving tool of the present invention includes not only the structure in which the weight starts to move in the second direction at the same time that or immediately after the operating member starts to move in the first direction but also a structure in which the weight starts to move in the second direction immediately before the operating members starts to move in the first direction. In the first to third embodiments, the nail driving machine C1 is used in a condition where the axis A1 is substantially vertical, along which the plunger 21 and the weight 91 move up and down, and the nail driving machine C1 may be used in a condition where the axis A1 is in a non-vertical direction.

Also, the fastener driving tool of the present invention includes not only the structure in which power from the battery is supplied to the electric motor but also a structure in which power from a commercial power supply is supplied to the electric motor. Further, a power source that generates power to be transmitted to the plunger and the weight includes not only the electric motor but also a hydraulic motor, engine, and the like.

EXPLANATION OF REFERENCE CHARACTERS

1C Nail driving machine
17 Electric motor
21 Plunger
21*c* First locking portion
21*d* Second locking portion
22 Driver blade
33 Engaging portion
34 Support pin
35 Roller
70 Drum
72 Wire
74 Cam
91 Weight
91*a* Cylindrical portion
91*e* First engaging projection
100 Nail
200 Driving cam
202 First gear
202*a*, 202*b*, 203*a* Cam roller
203 Second gear
A1 Axis
B1 First direction
B2 Second direction

The invention claimed is:

1. A fastener driving tool, comprising:
an operating member that moves along an axis and strikes a fastener;
a weight that moves along the axis; and
an elastic mechanism that is in contact with the operating member and the weight, a first end of the elastic mechanism being in contact with the operating member, a second end of the elastic mechanism being in contact with the weight,
wherein when the operating member moves in a first direction along the axis and the weight moves in a second direction, the elastic mechanism is compressed,
when the elastic mechanism decompresses, the elastic mechanism generates a repulsive force that moves the operating member in the second direction and the weight in the first direction, and
when the operating member moves in the second direction by the repulsive force, the operating member strikes the fastener.

2. The fastener driving tool according to claim 1,
further comprising a housing that houses the weight and the elastic mechanism therein, and
the first end of the elastic mechanism is not in contact with the housing.

3. The fastener driving tool according to claim 1,
wherein the operating member, the weight, and the elastic mechanism are aligned along the axis, and
the elastic mechanism is located between the operating member and the weight on the axis.

4. The fastener driving tool according to claim 1,
wherein the elastic mechanism is a metal spring that expands/contracts along the axis.

5. The fastener driving tool according to claim 1,
wherein the weight has a cylindrical portion formed around the axis.

6. The fastener driving tool according to claim 5,
wherein the elastic mechanism is disposed in the cylindrical portion.

7. The fastener driving tool according to claim 1,
wherein a power conversion mechanism that converts power transmitted from a power source into a compressive force that compresses the elastic mechanism is provided.

8. The fastener driving tool according to claim 7,
wherein the power source is an electric motor.

9. The fastener driving tool according to claim 8,
wherein the power conversion mechanism includes:
a first mechanism that causes the operating member to move in the first direction before the fastener is struck; and
a second mechanism that causes the weight to move in the second direction before the fastener is struck.

10. The fastener driving tool according to claim 8,
wherein the first mechanism includes:
a third rotating member that rotates by power from the electric motor;
a first engaging portion that is located at a position at which the first engaging portion is eccentric to the center of the third rotating member; and
a second engaging portion formed on the operating member and engaged with or disengaged from the first engaging portion,
the second mechanism includes:
a fourth rotating member that rotates by power from the third rotating member;
a third engaging portion that is located at a position at which the third engaging portion is eccentric to the center of the fourth rotating member; and
a fourth engaging portion that is formed on the weight and engaged with or disengaged from the third engaging portion,
before the fastener is struck, the third rotating member rotates to engage the first engaging portion with the second engaging portion, and power from the third rotating member is transmitted to the operating member to move in the first direction, and
before the fastener is struck, the fourth rotating member is rotated by power from the third rotating member to engage the third engaging portion with the fourth engaging portion and power from the fourth rotating member is transmitted to the weight to move in the second direction.

11. The fastener driving tool according to claim 1,
wherein one or more elastic mechanisms are located.

* * * * *